US008636435B2

(12) United States Patent
Rosner et al.

(10) Patent No.: US 8,636,435 B2
(45) Date of Patent: Jan. 28, 2014

(54) PORTABLE SPREADABLE FOOD DISPENSER SYSTEM

(75) Inventors: Jonathan Rosner, Novelty, OH (US); Alexander Sterling Wise, Mentor, OH (US); Francis Kiss deVirag, Kirtland Hills, OH (US); Ileen Rosner, Novelty, OH (US)

(73) Assignee: Innovative Consumer Solutions, LLC, Novelty, OH (US)

( * ) Notice: Subject to any disclaimer, the term of this patent is extended or adjusted under 35 U.S.C. 154(b) by 1275 days.

(21) Appl. No.: 11/847,253

(22) Filed: Aug. 29, 2007

(65) Prior Publication Data

US 2008/0124165 A1 May 29, 2008

Related U.S. Application Data

(60) Provisional application No. 60/823,869, filed on Aug. 29, 2006.

(51) Int. Cl.
*B43K 5/06* (2006.01)

(52) U.S. Cl.
USPC ..... 401/175; 401/174; 401/263; 401/265; 401/266

(58) Field of Classification Search
USPC ..... 401/172, 174, 175, 265, 266, 263; 222/63, 326, 333, 390
See application file for complete search history.

(56) References Cited

U.S. PATENT DOCUMENTS

| | | | | |
|---|---|---|---|---|
| 3,722,021 | A * | 3/1973 | Brainerd et al. | 401/190 |
| 5,484,087 | A * | 1/1996 | Negrych | 222/390 |
| 5,890,630 | A * | 4/1999 | Lobdell | 401/266 |
| 6,957,925 | B1 * | 10/2005 | Jacobs et al. | 401/175 |

* cited by examiner

*Primary Examiner* — Tuan N Nguyen
(74) *Attorney, Agent, or Firm* — Turocy & Watson, LLP

(57) ABSTRACT

A dispensing system for spreadable foodstuffs and spreadable non-food substances allowing for dispensing of metered amounts of product and spreading without the need for additional utensils not part of the packaging is disclosed. The system is composed of a disposable container containing a spreadable food stuff or non-food substance. The container comprises a mechanism for dispensing said foodstuff or non-food substances while proportionally decreasing the volume of the container. An alternative embodiment discloses a disposable dispenser allowing for spreading foodstuffs or non-food substances without any additional utensils in an ultra-portable unit without mechanical components.

17 Claims, 3 Drawing Sheets

PORTABLE SPREADABLE FOOD DISPENSER SYSTEM

TECHNICAL FIELD

The subject invention generally relates to a device for dispensing spreadable food products or other spreadable non-food substances. In particular, the subject invention relates to dispensing spreadable products evenly from a container without the use of a knife or other utensils not part of the packaging.

BACKGROUND

The vast majority of packaging of spreadable foodstuffs lack any functionality to allow contents to be used directly from the packaging. The packaging for spreadable foodstuffs such as ketchup, mustard, cream cheese, peanut putter, jelly, etc. typically require a knife or other utensil not part of the food packaging to remove the foodstuff from a container and/or achieve spreading the foodstuff as desired. Even containers that allow for squeezing the foodstuff contained therein directly out of the packaging often still require a utensil not part of the food packaging to evenly spread the foodstuff. Such containers also often do not dispense foodstuffs easily as the void space of the container increases as foodstuff is consumed. Often the contents may splatter or take a significant amount of time to flow due to a large volume of air in the container. Air being introduced to the container during the products use also negatively affects product freshness.

Traditional food containers are also typically challenging for children, elderly, disabled, or physically challenged individuals to use. Such containers also require utensils to be washed after every minor use of the product, which is a particular inconvenience during such activities as traveling, picnics, or other occasions where typical kitchen amenities are not present in addition to individuals who do not own a dishwasher.

The invention is also designed for use with a variety of non-food semi-solid or gelatinous substances. These substances include but are not limited to toothpaste, shoe polish, paints, cosmetics, thick oils, topical medications, and emollients. The typical containers for these substances are often the same and have the same limitations as those used for foodstuffs. These main limitations being the need for an additional utensils to remove and use the substance from the container, air being introduced to the containers over time as the substance is used, and difficulty of use for children or individuals with physical limitations.

SUMMARY

The following presents a simplified summary of the invention in order to provide a basic understanding of some aspects of the invention. This summary is not an extensive overview of the invention. It is intended to neither identify key or critical elements of the invention nor delineate the scope of the invention. Rather, the sole purpose of this summary is to present some concepts of the invention in a simplified form as a prelude to the more detailed description that is presented hereinafter.

The subject invention provides for spreadable foodstuffs and non-food substances to be packaged in a container that has a means for metering the dispensing of the contents and spreading in a knife-like manner without the use of any additional utensils as well as providing for a packaging of adjustable volume such that product is kept away from air during use. A solution is provided for overcoming the limitations of traditional packaging for spreadable foodstuffs and non-food substances. Additionally, a solution which is low cost and ultra-portable is provided that can find daily application in locales such as schools and the military.

One aspect of the invention relates to providing a convenient means of use of spreadable foodstuffs and non-food substances in residences without the need for utensils not part of the packaging. An additional aspect of the invention relates to providing a convenient and easy to use means for spreading foodstuffs and non-food substances for elderly, disabled, children, and physically challenged persons.

Another aspect of the invention relates to providing a convenient means of use of spreadable products for those traveling, picnics or other outdoor activities, or other times when traditional home amenities are not available. Yet another aspect of the invention relates to providing a means for restaurants and caterers to dispense and use spreadable foodstuffs with greater speed.

Still yet another aspect of the invention relates to providing a packaging for spreadable foodstuffs and non-food substances that keeps contents fresher once seal on package has been broken. Another aspect of the invention relates to minimizing waste of foodstuffs and non-food substances compared to traditional food packaging.

An additional aspect of the invention is to provide a packaging that is less disposable than traditional packaging and therefore suitable for targeted and affinity marketing in a more affective manner. An additional aspect of the invention is to provide an automated means of dispensing spreadable products that is ergonomical.

An additional aspect of the invention is to create an ultra-portable packaging for spreadable food stuffs and non-food substances allowing for spreading without additional utensils. Amazingly, still yet another aspect of the invention is to provide for an automated means of dispensing foodstuffs and non-food substances that may easily and rapidly switch between dispensing different products.

To the accomplishment of the foregoing and related ends, the invention comprises the features hereinafter fully described and particularly pointed out in the claims. The following description and the annexed drawings set forth in detail certain illustrative aspects and implementations of the invention. These are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION

The entire dispensing system is sold as one pre-assembled unit with foodstuff or non-food substance inside. The main feature of the invention is a knife-like applicator attached to the dispensing end, which has a triangular shape. One edge of the applicator has a series of holes or openings through which the product passes upon dispensing. In this manner, the product may be dispensed directly to the location of their desired use and immediately spread without the use of any other utensils besides the dispenser. In an alternate fashion, dispensing of the product may load the knife-like applicator with a desired amount, which may then be spread where desired.

The mechanical operation of the first embodiment of the dispensing system is as follows. The dispensing system contains a screw-spindle running along the longitudinal axis of the dispensing system. The non-dispensing end of the system is formed of a plunger member that is attached to said screw spindle. The plunger member forms a tight seal with the body of the dispensing system but still capable of sliding along the body of the dispensing system. A mechanism inside the dispensing system turns the screw-spindle which in turn moves the plunger member along the body of the dispensing system. Movement of the plunger member expels foodstuffs or non-food substances through the opening on the applicator. The mechanism inside the dispensing system is powered manually by the user. The dispensing system is designed to be disposable upon use of all the foodstuffs or non-food substances contained inside.

This first embodiment of the invention may be further modified to provide a function to measure the amount of foodstuff dispensed. The dispensing system may be manufactured out of transparent or semi-transparent material and graduations demarking weight or volume placed on the surface of the dispensing system. In this fashion, the movement of the plunger member relative to the graduations is observed by a user to determine the amount of spreadable foodstuff dispensed. To achieve a similar result, the turning of the screw-spindle is calibrated to a known movement of the plunger member and therefore a known amount of contents is dispensed. In this manner, each operation of the screw-spindle by the user results in a known amount of spreadable foodstuff or non-food substance being dispensed.

In a second embodiment of the invention, the knife-like applicator is attached to a flexible tube. The tube does not contain any internal mechanical components. The foodstuff or non-food substance contents are dispensed by the user squeezing from the end of the tube such that foodstuff is dispensed without air being introduced into the packaging.

Figure 1:
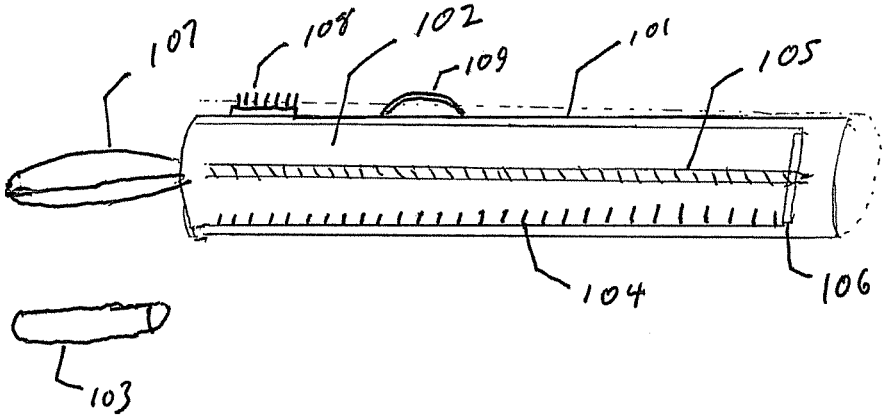
FIG. 1 is a view of the first embodiment of the invention, a disposable dispenser with a mechanical mechanism.

The dispensing system of the present invention is depicted in FIG. 1. The body of the dispenser 101 is composed of rigid or semi-rigid food-grade or chemical resistant material as the application requires. The dispensing system has a mostly a hollow space 102 which contains the spreadable foodstuffs or non-food substances. The contents are kept fresh by a lid 103 before the dispensing system is placed in use. The lid 103 can be replaced such that the dispensing system can be stored before the contents are completely consumed. Optionally, the body of the dispensing system 102 is made from transparent or semi-transparent material and graduations are placed on the body of the dispensing system 104. There is a screw-spindle 105 running along the longitudinal axis of the dispensing system. There is a plunger member 106 located at one end of the dispensing system. A tube may optionally be placed along the longitudinal axis of the dispensing system such that the screw-spindle 105 is kept out of contact with the foodstuff contained in the hollow space 102. If need be, the contents can be manually squeezed out of the dispensing system when the dispensing system is constructed out of semi-rigid material.

Figure 2A:
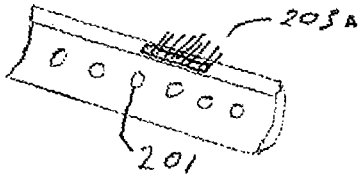
FIG. 2A is a view of the knife-like applicator.
Figure 2B:
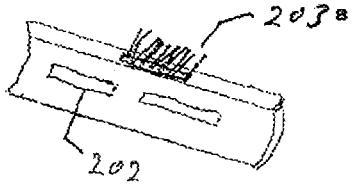
FIG. 2B is another view of a knife-like applicator.

The dispensing end of the dispensing system applicator 107 is in one piece with the rest of the dispensing system and is shaped in a triangular knife-like shape. Several views of the applicator region are shown in FIG. 2A and FIG. 2B. The number and diameter of the openings is selected based on the consistency or viscosity of the product. For example, in FIG. 2A, dispensing end 203A depicts a larger number of smaller holes 201 are useful for less viscose products such as jelly, ketchup or emollients. In FIG. 2B, dispensing end 203B depicts large holes 202 are appropriate for very viscose products such as peanut butter, cream cheese or shoe polish. The flat surface of the applicator is used in a knife-like fashion to spread the food stuffs as desired. Also, depending of the viscosity of the foodstuffs, the foodstuffs may be dispensed completely onto a surface and then spread. For some high viscosity foodstuffs, dispensing of such foodstuff may preload the head with food product that may then be spread onto a desired location. Additionally, certain applications, such as shoe polish or paints, may benefit from a built-in bristles or brushes on the dispensing ends 107, 203A, or 203B.

In the first embodiment, the screw-spindle 105 is rotated manually upon depressing a button 109 located on the surface of the dispensing system. Alternatively, the button 109 may be replaced with a rotating wheel to allow for more rapid dispensing of the contents depending on the application desired. Methods for coupling the mechanical depression of a button/rotating wheel to rotation of a gear and/or screw spindle are well known in the art. Each depression of the button 109 results in a known rotation of the screw-spindle 105 and therefore a known amount of contents are dispensed. When a rotating wheel is employed, such wheel may be demarked with graduations giving the user the ability to know how much foodstuff is to being dispensed.

Figure 3:
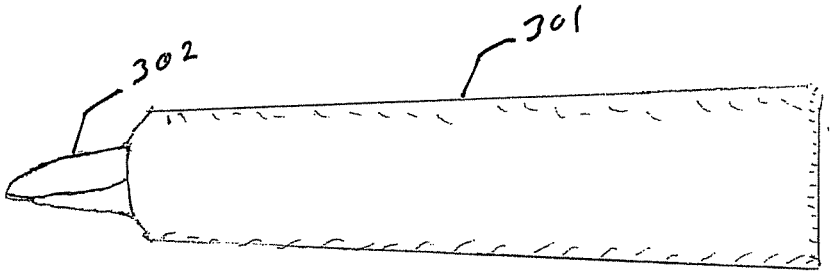
FIG. 3 is a view of the second embodiment of the invention, a disposable dispenser operated by a squeezing action.

The second embodiment of the invention is shown in FIG. 3. The body of the dispensing system 301 is composed of flexible food-grade or chemical resistant material. The same or similar knife-like applicator 302 is used as in the first embodiment. Foodstuffs or non-food substances are dispensed by applying pressure to the end of the dispensing system. In this manner, contents are dispensed and introduction of air is minimized.

While the invention has been explained in relation to certain embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A dispensing system comprising:

a knife shaped applicator, the knife shaped applicator comprising an outer spreading surface and at least one opening along the outer surface, wherein the number of openings is based on one or more characteristics of a foodstuff or a non-food substance;

a container connected to the knife shaped applicator, wherein the container contains the foodstuff or a non-food substance and the knife shaped applicator dispenses the foodstuff or the non-food substance through the at least one opening;

a tube arranged along a longitudinal axis of the container;

a screw-spindle within the tube and attached to a plunger member located within the container:

a rotation mechanism within the container and connected to the screw-spindle, the rotation mechanism comprising a button or wheel accessible to a user, wherein rotation of the screw-spindle associated with the plunger expels a known amount of the foodstuff or non-food substance through the at least one opening along the outer spreading surface of the knife shaped applicator without air being introduced into the container; and a measuring member, calibrated with the screw-spindle, that measure an amount of dispensed foodstuff or non-food substance.

2. The dispensing system of claim 1, the container is constructed of at least one of a semi-rigid material, transparent material or semi-transparent material.

3. The dispensing system of claim 1, wherein the measuring member comprises graduations demarked on the container to determine a quantity of foodstuffs or non-food substances dispensed.

4. The dispensing system of claim 1, wherein the container is deformable in a manner wherein such deformation dispense the foodstuffs or non-food substances from the container.

5. The dispensing system of claim 1, wherein a user can determine a quantity of foodstuffs or non-food substances to dispense.

6. The dispensing system of claim 1, the screw-spindle and the plunger move via manual or mechanical power input.

7. The dispensing system of claim 1, wherein the knife shaped applicator further comprises a brush.

8. The dispensing system of claim 1, wherein the wheel comprising markings denoting the quantity of dispensed foodstuffs or non-food substances.

9. The dispensing system of claim 1, wherein the knife shaped applicator further comprises a head portion, the head portion positioned to receive the dispensed foodstuffs or non-food substances.

10. A method of dispensing foodstuffs and non-food substances from a dispenser, comprising:

depressing a button, or rotating a wheel, to actuate a rotation mechanism located within a container and connected to a screw-spindle located within a tube arranged along the longitudinal axis of the container and inside the container;

sliding a plunger member along the screw-spindle within the container, wherein the container is containing a foodstuff or non-food substance;

dispensing a known amount of the foodstuffs or non-food substances through at least one opening of a knife shaped applicator for passing the foodstuff or non-food substance from the container without air being introduced into the container;

measuring an amount of dispensed foodstuff or non-foodstuff;

decreasing the volume of the container in proportion to the amount foodstuff or non-food substance dispensed; and spreading the foodstuff or non-food substance on a surface.

11. The method of claim 10 further comprising selecting the size of the at least one opening to accommodate the viscosity of the foodstuff or non-food substance.

12. The method of claim 10 further comprising selecting the quantity of the at least one opening to accommodate the viscosity of the foodstuff or non-food substance.

13. The method according to claim 10, wherein the foodstuffs or non-food substances is dispensed on an outer surface of the knife shaped applicator.

14. The method according to claim 13, further comprising spreading the foodstuff or non-foodstuff that is dispensed on the outer surface of the knife shaped applicator on a surface.

15. The method according to claim 10, with the proviso that the method does not comprise spreading the foodstuffs or the non-food substances without utensils separate from the dispenser.

16. The method of claim 10, further comprising:

selecting a quantity of foodstuff or non-food substance to be dispensed; and dispensing the known quantity of foodstuff or non-food substance.

17. A dispensing system, comprising:

means for storing a foodstuff or non-food substance in a container;

means for actuating a rotation mechanism via a button or wheel;

means for moving a plunger member attached to a screw-spindle located inside a tube within the container such that movement of the plunger member dispenses a known amount of the foodstuff or non-food substance from the container without air being introduced into the container;

means for decreasing the volume of the container in proportion to the amount of foodstuff or non-food substance dispensed;

means for measuring an amount of the dispensed foodstuff or non-food substance;

means for transferring the foodstuff or non-food substance to a surface; and means for spreading the foodstuff or non-food substance on a surface.

* * * * *